US007007367B2

(12) United States Patent
Ferguson et al.

(10) Patent No.: US 7,007,367 B2
(45) Date of Patent: Mar. 7, 2006

(54) APPARATUS AND METHOD FOR SECURING ITEMS TO A HANGABLE MERCHANDISER

(75) Inventors: Mark A. Ferguson, Memphis, NY (US); Jeffrey P. Pirro, Marcellus, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 266 days.

(21) Appl. No.: 10/678,894

(22) Filed: Oct. 3, 2003

(65) Prior Publication Data

US 2005/0071982 A1 Apr. 7, 2005

(51) Int. Cl.
*B23Q 3/00* (2006.01)
*B21D 39/03* (2006.01)
*B21K 5/00* (2006.01)

(52) U.S. Cl. ..... 29/454; 29/428; 29/242

(58) Field of Classification Search ..... 206/372, 206/45.24; 248/316.7; 211/118, 113, 85.15, 211/71.01; 29/242, 428, 464
See application file for complete search history.

(56) References Cited

U.S. PATENT DOCUMENTS

| | | | | |
|---|---|---|---|---|
| 2,155,313 A | | 4/1939 | Jackson | 206/46 |
| 3,425,889 A | | 2/1969 | Willits | 161/43 |
| 4,301,575 A | | 11/1981 | Goldberg | 24/1 |
| 5,103,970 A | | 4/1992 | Nielson et al. | 206/45.14 |
| 5,130,970 A | * | 7/1992 | Ohta | 369/100 |
| 5,405,022 A | | 4/1995 | Rissley | 211/59.1 |
| 5,497,882 A | | 3/1996 | Kenyon | 206/485 |
| 5,553,721 A | * | 9/1996 | Gebka | 211/59.1 |
| 6,145,675 A | | 11/2000 | Kass et al. | 211/71.01 |
| 6,195,877 B1 | | 3/2001 | Poulokefalos | 29/819 |

FOREIGN PATENT DOCUMENTS

WO 8504560 10/1985

* cited by examiner

*Primary Examiner*—John C. Hong
(74) *Attorney, Agent, or Firm*—Stewart A. Fraser

(57) ABSTRACT

An apparatus and process for simultaneously securing a plurality of display articles onto a hangable merchandiser are disclosed. The apparatus includes a strip shaped hangar and a detachable handle secured to the strip. The handle is used to secure the display articles to the strip and then the handle is detached from the strip. The process reduces the cost of securing display articles to the strip.

36 Claims, 11 Drawing Sheets

APPARATUS AND METHOD FOR SECURING ITEMS TO A HANGABLE MERCHANDISER

BACKGROUND OF THE INVENTION

This invention generally relates to point of purchase display systems that are suitable for use in retail environments. The present invention also relates to processes for assembling the display systems with the articles to be displayed.

Merchandising systems are used in retail stores to display items for sale in an attractive, easy to access and space efficient manner. To be commercially viable, the merchandising systems must meet a number of requirements. Some of the more important requirements are that the merchandisers be inexpensive to manufacture, utilize a minimum amount of labor to load the items onto the merchandiser and occupy little volume during shipment and/or use in the store. Ideally, the merchandiser is fully loaded at the factory with the articles to be sold and then, with little additional effort on the part of the store employee, the loaded merchandiser can be setup in the store.

A variety of merchandising systems that address the above described issues are known. One such system uses hangable strips to display the articles to be sold. However, each strip incurs labor costs associated with securing the articles to the strip. In one example, the strip is a metal rod with clips secured thereto and distributed along the length of the rod. Each package to be sold must be manually secured to a clip. This action requires individual handling of each package thus adding to the final cost of the product.

As disclosed in U.S. Pat. No. 6,195,877, a machine can be used to secure the items to be sold to the hang strip. The machine provides a supply of hang strip material and an item attachment station that enables the items to be individually connected to the strip. While the described apparatus is faster than loading the strips by hand, an operator must individually handle each item to be loaded on the strip. Furthermore, the design, construction and maintenance of the machine add to the final cost of loading the product onto the strip.

Another example of a strip merchandiser is disclosed in U.S. Pat. No. 6,145,675. This strip merchandiser utilizes a tongue and at least one shoulder that protrudes from the surface of the strip to secure the packages to the strip. Unfortunately, the design of the merchandiser requires that the packages be individually loaded on the strip. Thus the cost of loading the strip remains high.

Disclosed in U.S. Pat. No. 5,103,970 is a collapsible display system. The system described therein includes a flexible, fan foldable strip that can be loaded with items to be sold and then collapsed into a compact stack for shipping. As with the other merchandising systems described above, this system requires that each item secured to the strip be individually handled. Thus, the cost of loading the strip must be incurred and passed along to the consumer.

Accordingly, there is a need for a merchandising system that will substantially reduce the cost of loading items to be sold onto a hangable strip by enabling an individual to simultaneously load more than one item at a time onto the strip.

BRIEF SUMMARY OF THE INVENTION

In one embodiment, the present invention is an apparatus that enables the simultaneous loading of a plurality of display articles onto a hangable strip shaped merchandiser.

The apparatus includes a strip shaped element and a detachable handle in contact with the strip. The strip has an undulating cross sectional configuration having a series of folds. The strip includes intermediate segments that are located between sequential folds in the strip shaped element. The intermediate segments include connection means located thereon. The detachable handle contacts the series of folds at one or more points of contact.

In another embodiment, the present invention is a process. One step of the process includes providing an apparatus having a handle and an undulating strip member secured to one another. The strip includes a plurality of releasable connection means located along the length of the strip. Another step includes providing a plurality of display articles that each have at least one releasable engagement means. Another step includes contacting the apparatus' strip to the plurality of display articles so that the strip's connection means engage the display articles' engagement means thereby releasably securing the display articles to the strip. In another step, the handle is separated from the strip to which the display articles are secured.

DETAILED DESCRIPTION OF THE INVENTION

Figure 1:
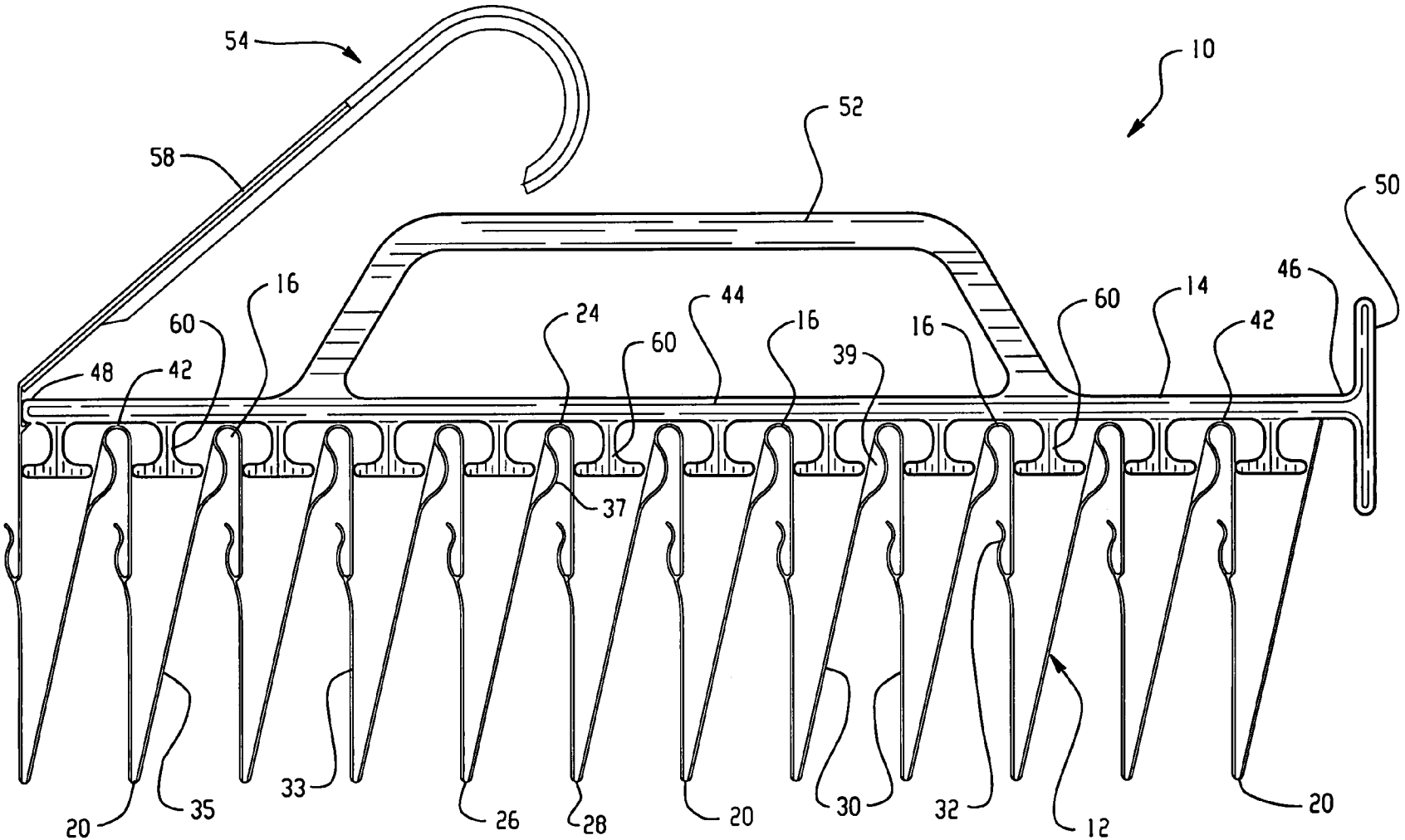
FIG. 1 is a side view of an apparatus of this invention.
Figure 2A:
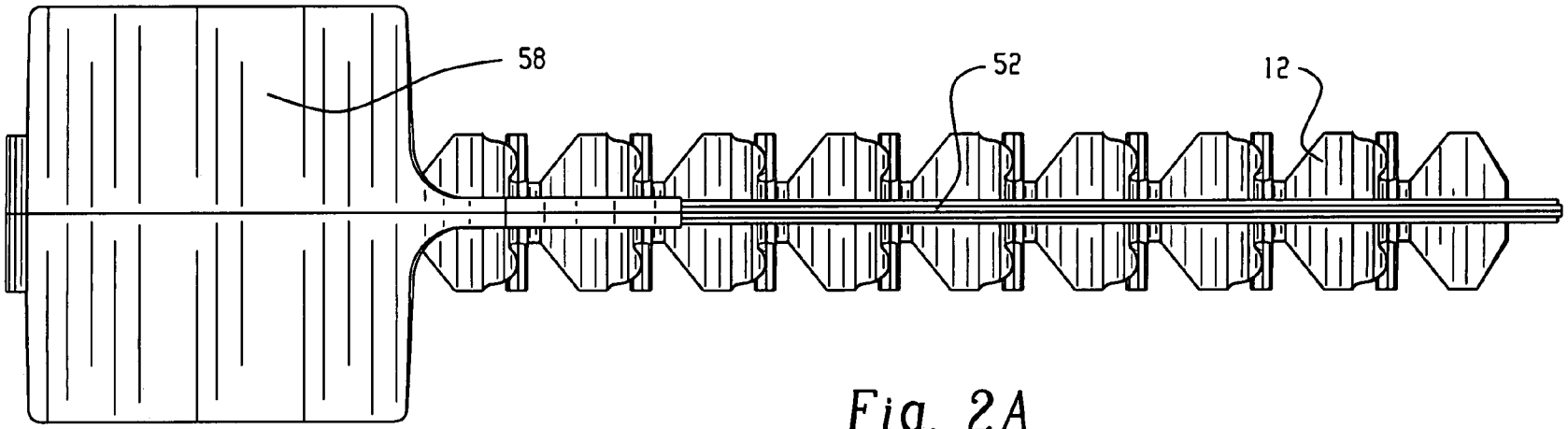
FIG. 2A shows the top view of the apparatus shown in FIG. 1.
Figure 2B:
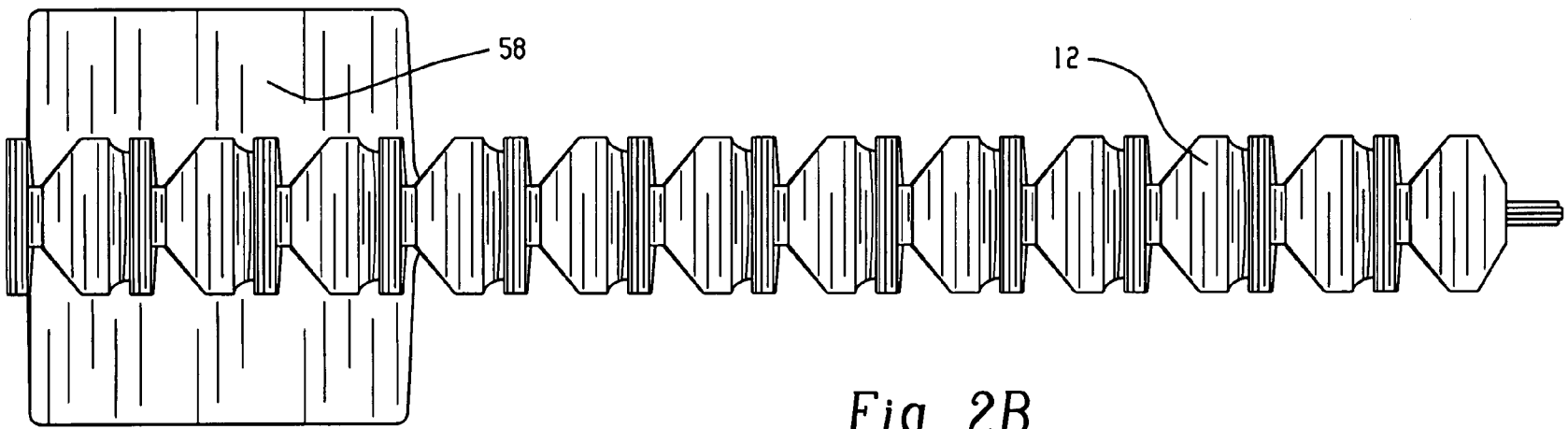
FIG. 2B shows the bottom view of the apparatus shown in FIG. 1.
Figure 2C:
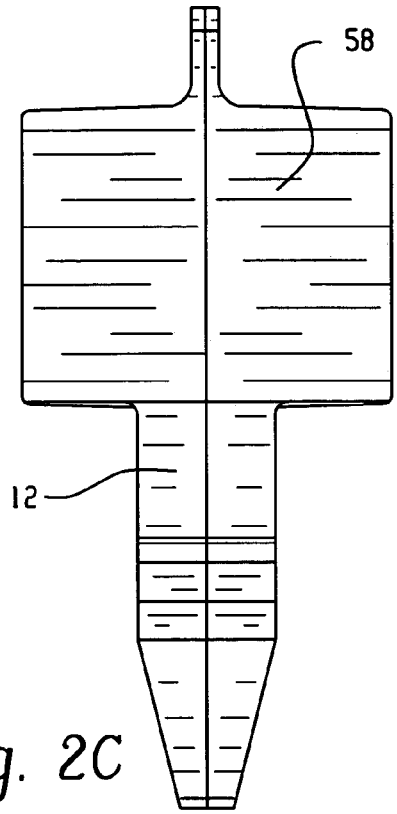
FIG. 2C shows one end of the apparatus shown in FIG. 1.
Figure 2D:
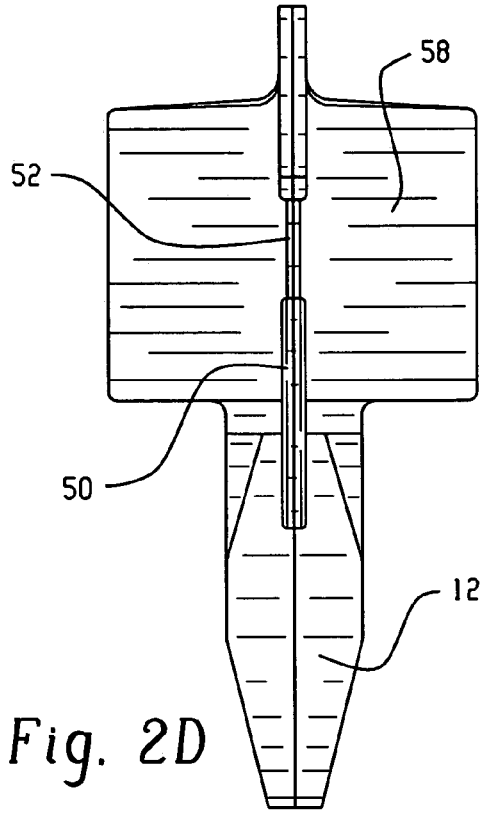
FIG. 2D shows another end of the apparatus shown in FIG. 1.

Referring now to the drawings, which are intended to illustrate the preferred embodiments of the invention, FIG. 1 shows an apparatus 10 that includes an undulating strip shaped element 12 and a handle 14. Strip element 12 includes a first series of folds 16 that are substantially aligned with one another thereby forming a first edge 18 (see FIG. 3) which is an imaginary line that passes along the outer surfaces of the first series of folds 16. Strip element 12 also includes a second series of folds 20 that are substantially aligned with one another thereby forming a second edge 22 (see FIG. 3) which is an imaginary line that passes along the outer surfaces of the second series of folds 20. The folds function as hinges that allow the strip to straighten as will be explained later. Between sequential folds are intermediate segments 30. Some of the intermediate segments, such as the segment between folds 24 and 28, include a connection means 32 and are referred to herein as connection segments 33. Other intermediate segments, such as the segment between folds 24 and 26, do not include a connection means and are referred to as guiding segments 35. The guiding segments are used to force the display article toward the opposing connection segment so that the display article's engagement means can easily and reliably engage the strip's connection means. Guiding segments 35 include a curved portion 37 that forces the display card toward connection means 32. Curved portion 37 is located proximate the fold that connects the guiding segment to its abutting connection segment. A reinforcing rib 39 stiffens the curved portion 37 so that it will not yield during the attachment process. Rib 39 also contacts an end of protrusion 60 thereby insuring that folds 60 are properly spaced along the length of handle 14. Strip shaped element 12 has two ends. The leading end 54 of strip 12 may include a flat rectangular section 58 onto which information pertaining to the product may be printed. In addition, leading end 54 includes a hook which functions as a means for securing a strip loaded with display articles to a support structure such as a shelf in a store.

Attached to strip 12 is handle 14. The strip and handle are secured to one another at a plurality of points of contact 42. Handle 14 includes an elongated portion 44 that traverses virtually the entire length of first edge 18. In this embodiment, elongated portion 44 has a first end 46 and a second end 48 (see FIG. 4). To facilitate practical handling of apparatus 10, strip 12 should be connected to handle 14 at two or more points of contact. One point of contact should be near the first end 46 of handle 44 and another point of contact should be near the second end 48 of handle portion 44. Additional points of contact may be needed near the middle of handle portion 44 to prevent sagging of the undulated strip when the apparatus is held by an operator as shown in FIG. 5. A terminal section 50 abuts first end 46 to form a T-shaped handle. Another component of handle 14 is midsection 52 which is secured to the side of the handle opposite the points of contact 42. Midsection 52 is preferably shaped to facilitate manual grasping of the apparatus as shown by the phantom hand shown in FIG. 4. Several protrusions 60 extend from elongated portion 44 toward strip 12. The protrusions are located between consecutive folds in the first series of folds. The protrusions serve as spacers between the folds.

FIGS. 2A, 2B, 2C and 2D show the top, bottom, left side and right side views, respectively, of the apparatus shown in FIG. 1.

Figure 3:
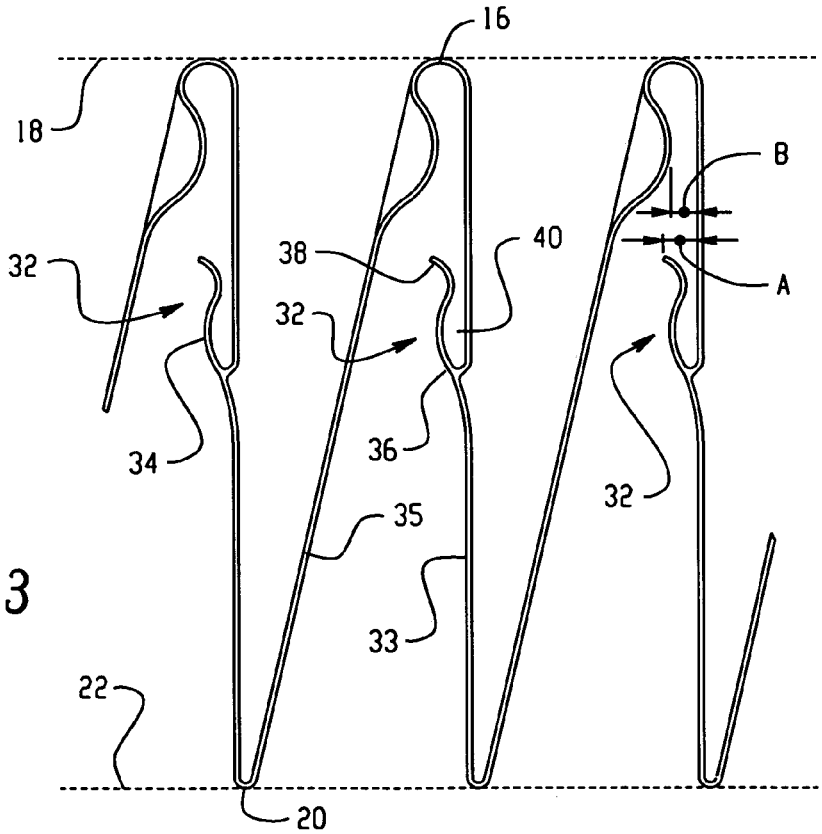
FIG. 3 is an enlarged side view of a portion of the apparatus shown in FIG. 1.

The preferred embodiment of connection means 32 is shown in FIGS. 1 and 3. However, the connection means could take a variety of shapes provided the connection means releasably secures the display articles to strip 12. The connection means may be formed as an integral part of the strip shaped element or the connection means may be formed separately and then secured to the strip by the use of an adhesive or mechanical attachment.

Referring now to FIG. 3, a first embodiment of connection means 32 are formed on the surfaces of connection segments 33. In this embodiment, the connection means includes a tab 34 that has a proximate end 36, contacting connection segment 33, and a distal end 38. Cavity 40, which is the space between tab 34 and connection segment 33, provides a releasable connection that is used to engage the engagement means on the display articles as will be explained below. In the preferred embodiment, only one connection means is formed on every other intermediate segment. However, if desired, more than one connection means could be secured to a single connection segment. Furthermore, connection means could be secured to every intermediate segment rather than every other segment.

Figure 4:
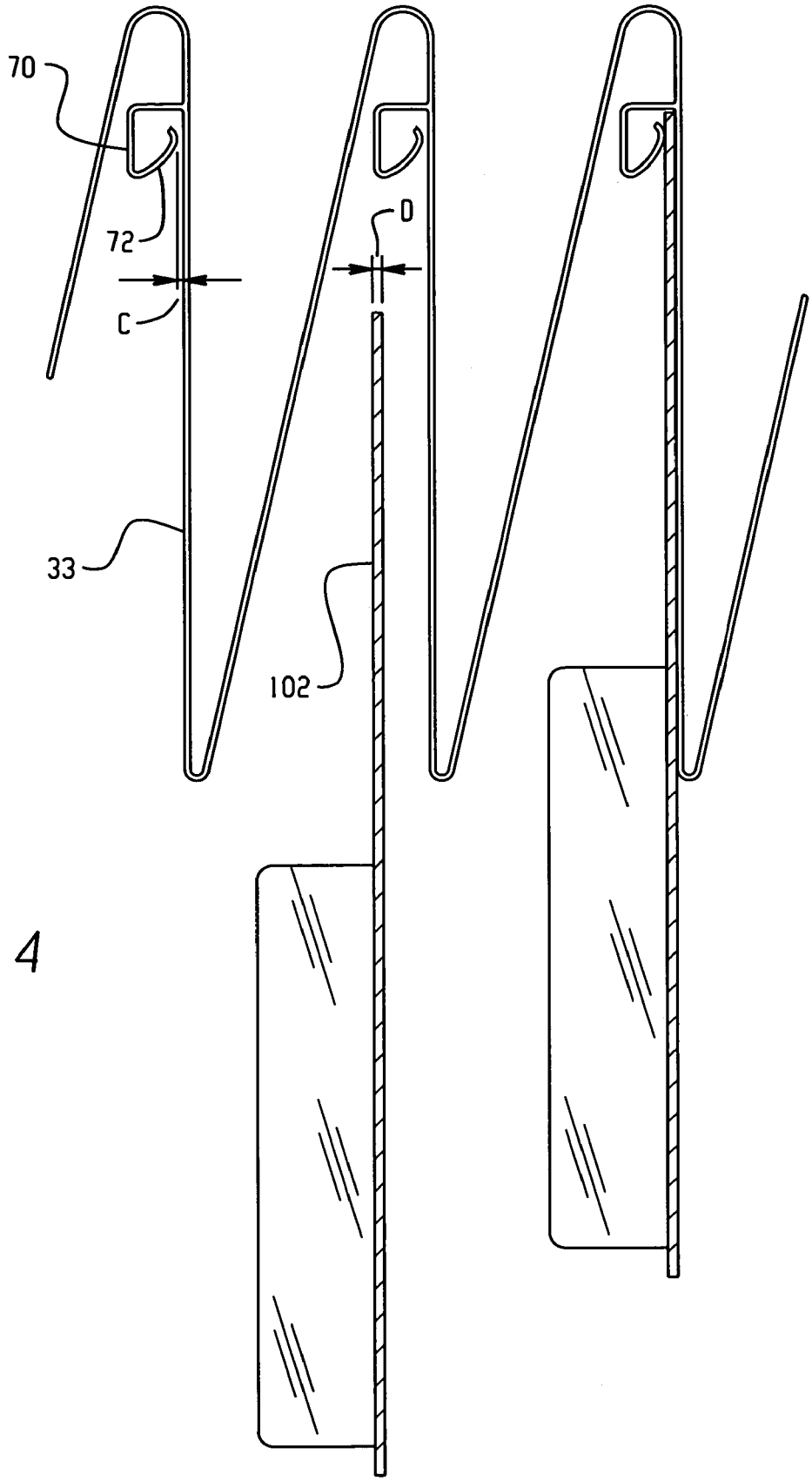
FIG. 4 is an enlarged side view of an alternate embodiment of an apparatus of this invention.
Figure 5:
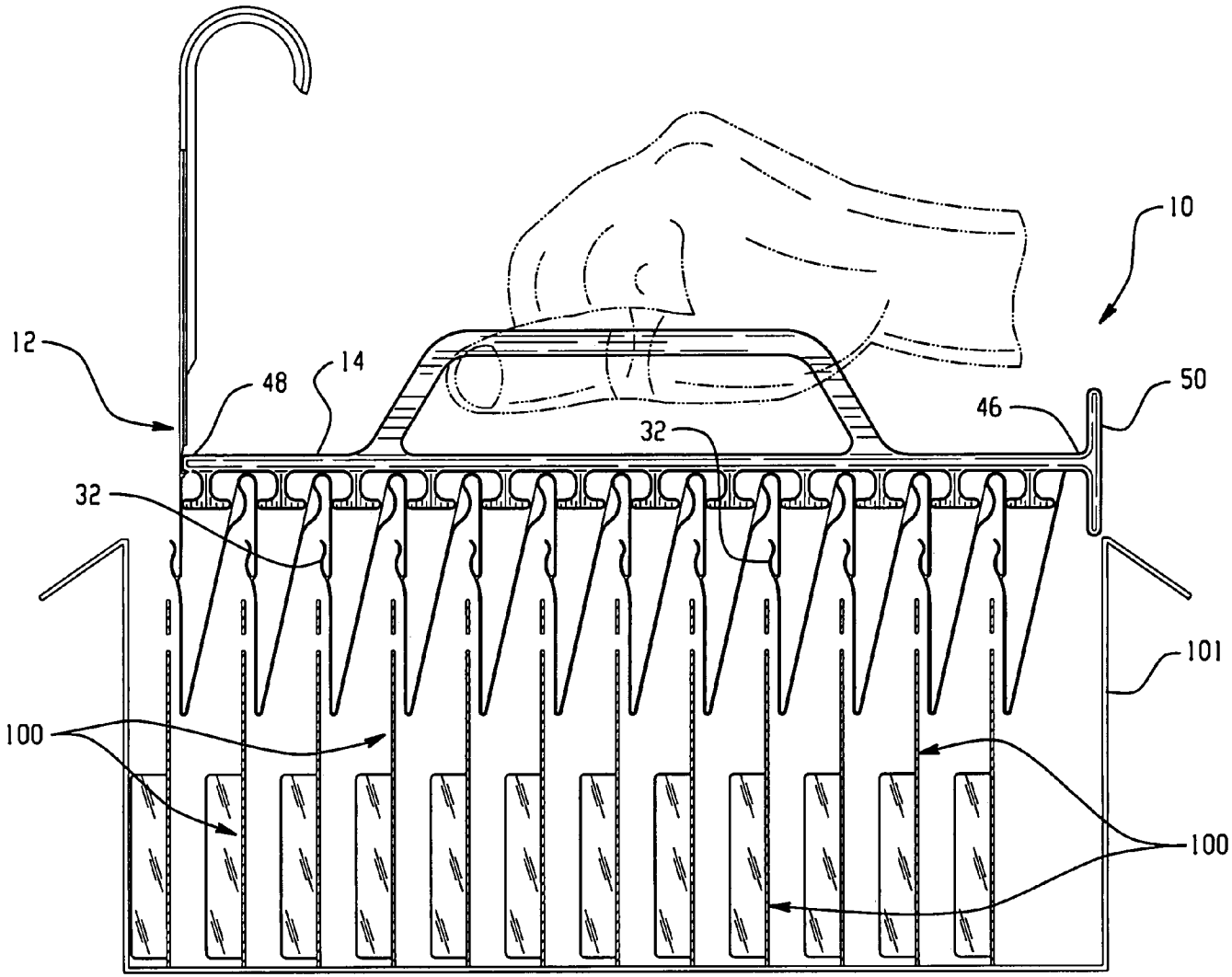
FIG. 5 is a side view of an apparatus of this invention positioned above a plurality of articles to be secured to the strip.
Figure 10:
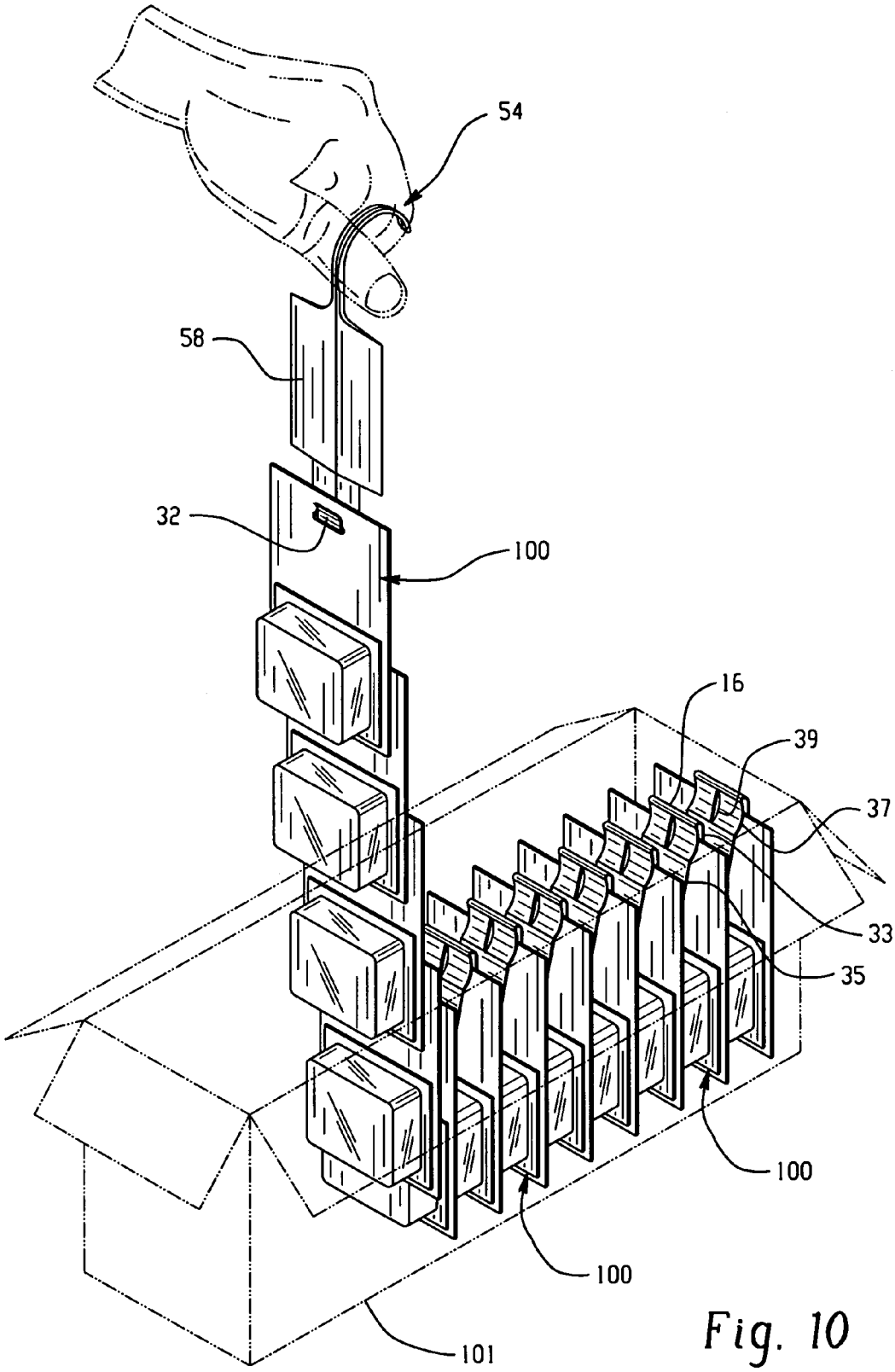
FIG. 10 is a perspective view of a fully loaded apparatus of this invention as the strip is pulled from its container.
Figure 11:
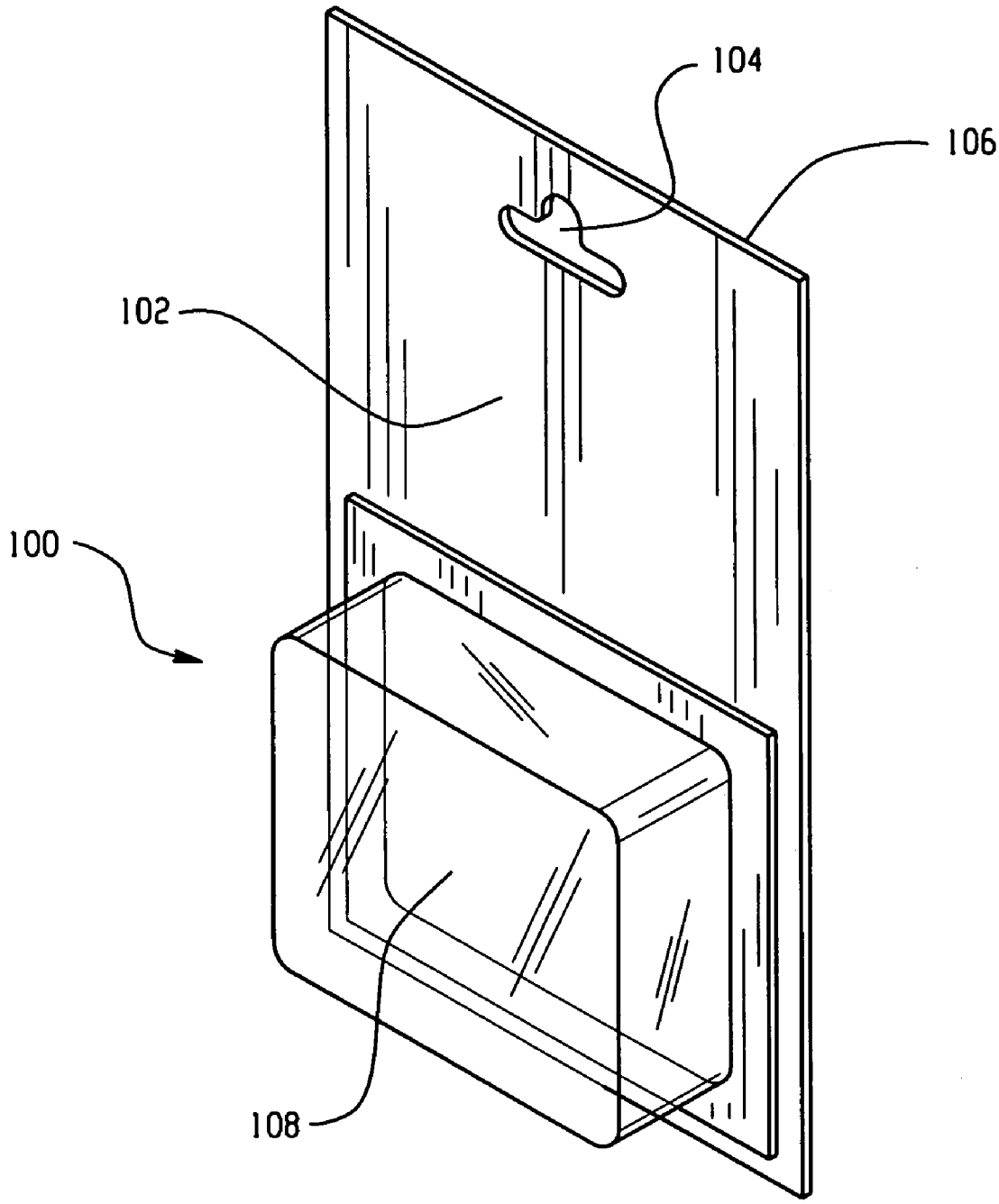
FIG. 11 is a perspective view of a display article that could be secured to the strip.

A second embodiment of the connection means is shown in FIG. 4. In this embodiment, a flexible projection 70 extends from connection segment 33 to form a barb or finger 72 that can be used to trap a portion of the display article's planar component 102 between connection segment 33 and projection 70. To function properly, the distance between the free end of finger 72 and connection segment 33, designated distance "C" in FIG. 4, must be less than the thickness of planar component 102 which is designated as distance D in FIG. 4. Because friction is used to secure the display article to the strip, the planar component does not need an opening 104 defined therein as shown in FIG. 11. To remove the display article shown in FIG. 4 from a fully extended strip as generally shown in FIG. 10, the consumer would pull on the display article with sufficient force to overcome the friction between the planar component and the flexible projection.

An apparatus of this invention may be manufactured using an injection molding process that forms the apparatus as a unitary component. The apparatus can be injection molded from materials such as polypropylene, styrene, acrylonitrile-butadiene-styrene (ABS) and polyethylene. The material used will influence the design parameters of the apparatus, especially the thickness of the points of contact and folds. Critical aspects of an injection molded apparatus are the points of contact that secure the strip to the handle and the folds that define the first and second edges of the strip. The points of contact must be frangible so that the handle can be easily separated from the strip by twisting the handle about the elongated section's longitudinal axis until the points of contact are broken thereby releasing the handle from the strip. The points of contact must be able to keep the handle and strip secured to one another during normal handling of the apparatus prior to contacting the connection means to the display articles as will be explained below. At the same time, the points of contact must be frangible so that the handle can be easily separated from the strip by twisting the handle with one hand. Preferably, the strength of the points of contact will allow the handle to be separated from the strip by turning the handle's terminal section 50 one quarter of a turn either clockwise or counterclockwise. If needed, the handle may be turned two or more times to insure complete separation of the handle from the strip.

The folds, 16 and 20, that define the first and second edges of strip 12 are critical parts because the folds must act as durable hinges. The folds must be sufficiently flexible to allow the collapsed strip to be straightened after the strip has been loaded with display items and then hung from a support structure. If the folds are too stiff, the loaded strip will not be able to elongate and function in a satisfactory manner. If the folds are too thin, the strip could tear at the folds thus destroying the integrity of the strip.

An alternative to making the apparatus as a unitary component is to make strip 12 and handle 14 as separate components and then secure them to one another. The apparatus could be designed so that the handle is secured to the folded strip by an interference fit. The apparatus could also be assembled by gluing the handle to the folded strip provided the glued connections can be easily broken by twisting the handle as described above. In another embodiment, the strip could be formed from individually molded connection segments and guiding segments which are joined to one another to form a flexible strip which is then attached to a handle.

Referring now to FIGS. 5, 6, 7 and 8, the preferred process for securing display articles to a folded strip merchandiser will now be described. Beginning with FIG. 5, apparatus 10 is provided. The apparatus includes handle 14 and undulating strip shaped element 12 that are secured to one another. Strip 12 has a plurality of releasable connection means 32 located along the length of the strip. Apparatus 10 is positioned over a plurality of display articles 100. The articles are arranged in an open ended container 101. As shown in FIG. 11, each display article has a planar component 102, such as a rectangularly shaped piece of paperboard, that defines an opening 104 therethrough and a shallow cup shaped tray typically formed of a transparent thermoformable material secured to the planar component. An edge 106 defines the perimeter of the planar component. Preferably, opening 104 is located proximate edge 106. Referring again to FIG. 5, the display articles are aligned and separated within the container to correspond to the distance between the strip's connection means. Each article has at least one releasable engagement means incorporated into the article. In this embodiment, the engagement means is the opening 104 in planar component 102. As shown by the phantom hand in FIG. 5, the apparatus can be easily controlled with one hand.

Figure 6:
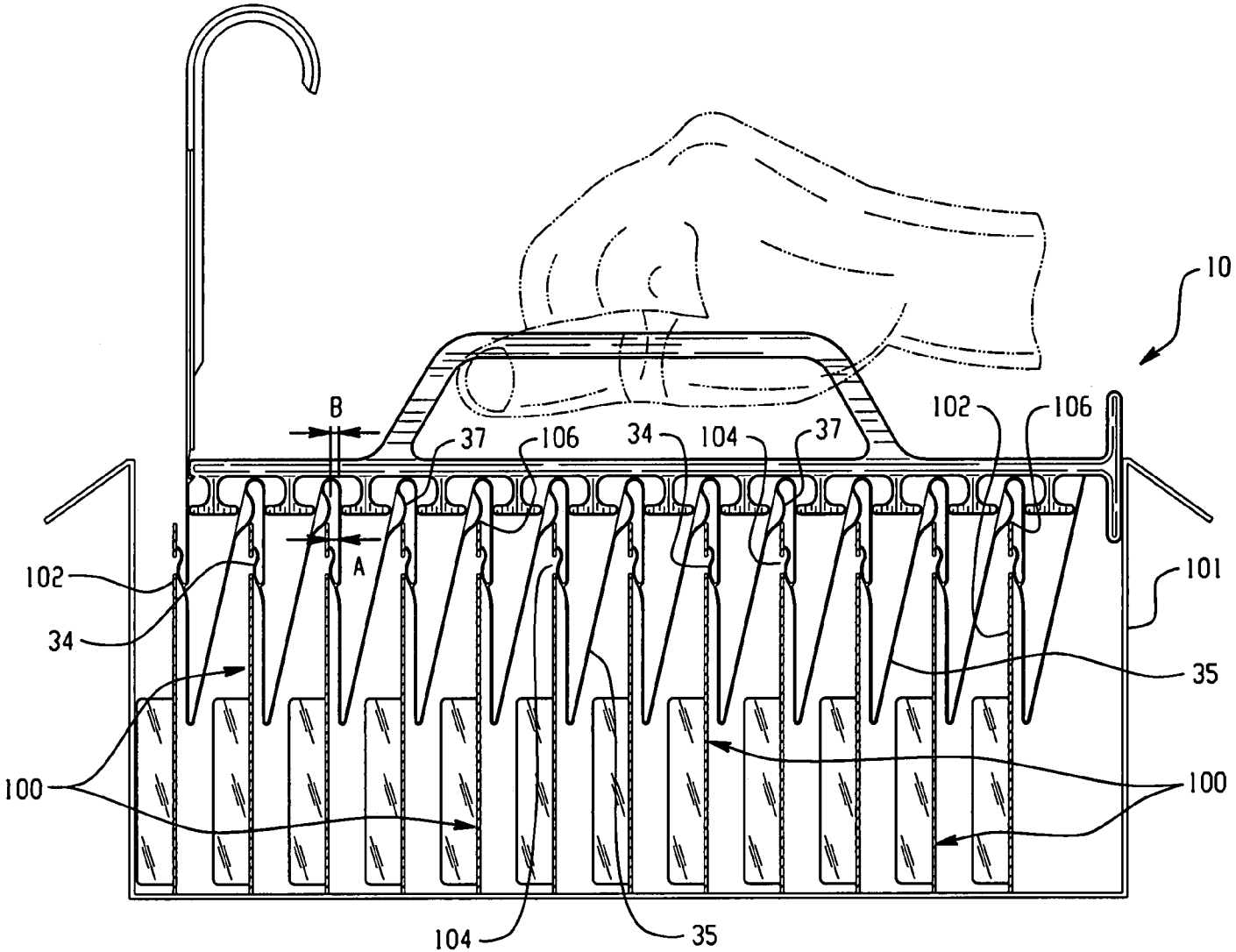
FIG. 6 is a side view of an apparatus of this invention immediately prior to the display articles engaging the strip.

FIG. 6 discloses a container 101 holding a plurality of display articles 100 and an apparatus 10 that has been partially inserted over the display articles. In this view, an edge 106 of each display article's planar component 102 is contacting the convex surface of curved portion 37 which forms a part of guiding segment 35. As the apparatus is forced toward the display articles, the planar component is laterally displaced toward tab 34 which is designed to extend through opening 104 in component 102. Reliable insertion of the tab into the opening is assured by the relative positioning of the curved portion of guiding segment 35 and the distal end of tab 34. Specifically, the curved portion of the guiding segment must extend laterally toward and beyond the distal end 38 of tab 34. As shown in FIG. 3, the preferred arrangement of tab 34 and curved portion 37 is achieved when the shortest distance between the distal end 38 of tab 34 and the connection segment from which tab 34 extends, shown as distance A in FIG. 3, is equal to or greater than the shortest distance, represented by distance B in FIG. 3, between the curved portion 37 of guiding segment 35 and the connection segment from which tab 34 extends. As shown in FIG. 6, the motion of inserting apparatus 10 onto the plurality of display articles forces edge 106 of planar component 102 toward the guiding segment where the edge contacts the convex surface of curved portion 37 of guiding segment 35 thereby forcing the planar component in the opposite direction and against the tab. Due to the contact between the tab and planar component, the tab immediately extends through opening 104 as soon as opening 104 passes the distal end 38 of tab 34.

Figure 7:
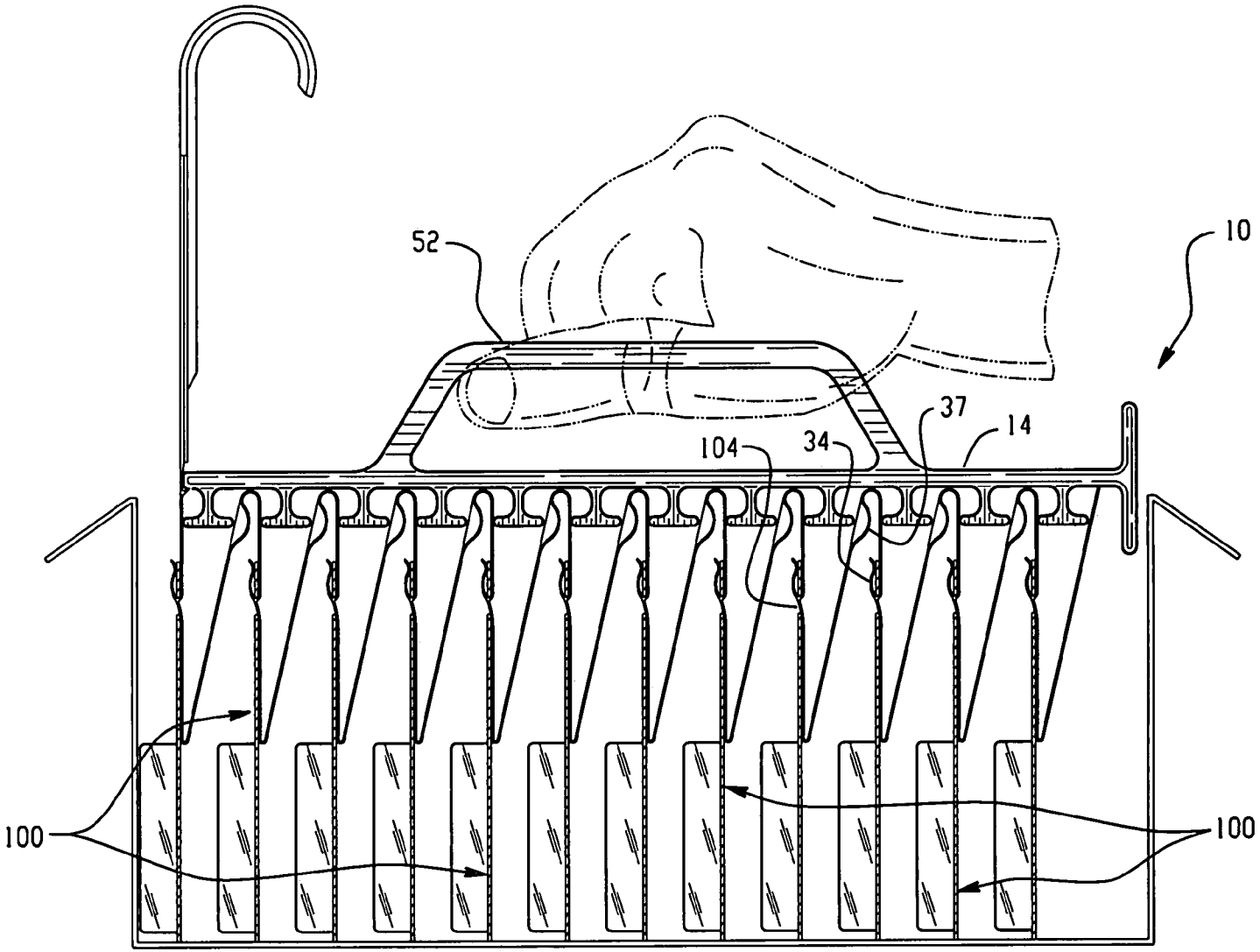
FIG. 7 is a side view of an apparatus of this invention engaging the articles to be displayed.

FIG. 7 represents the step of fully contacting the apparatus' strip to the plurality of display articles so that the strip's releasable connection means completely engage the display articles' releasable engagement means. The apparatus is loaded by grasping apparatus 10 about midsection 52 of handle 14 and forcing the entire apparatus downward onto the plurality of display articles until tabs 34 are able to extend through openings 104 in the display articles' planar component 102. The apparatus may then be pulled away from the display articles to force the portion of the planar component located between opening 104 and the planar component's edge 106 to become firmly wedged in cavity 40 thereby suspending the article from the strip member.

Figure 8:
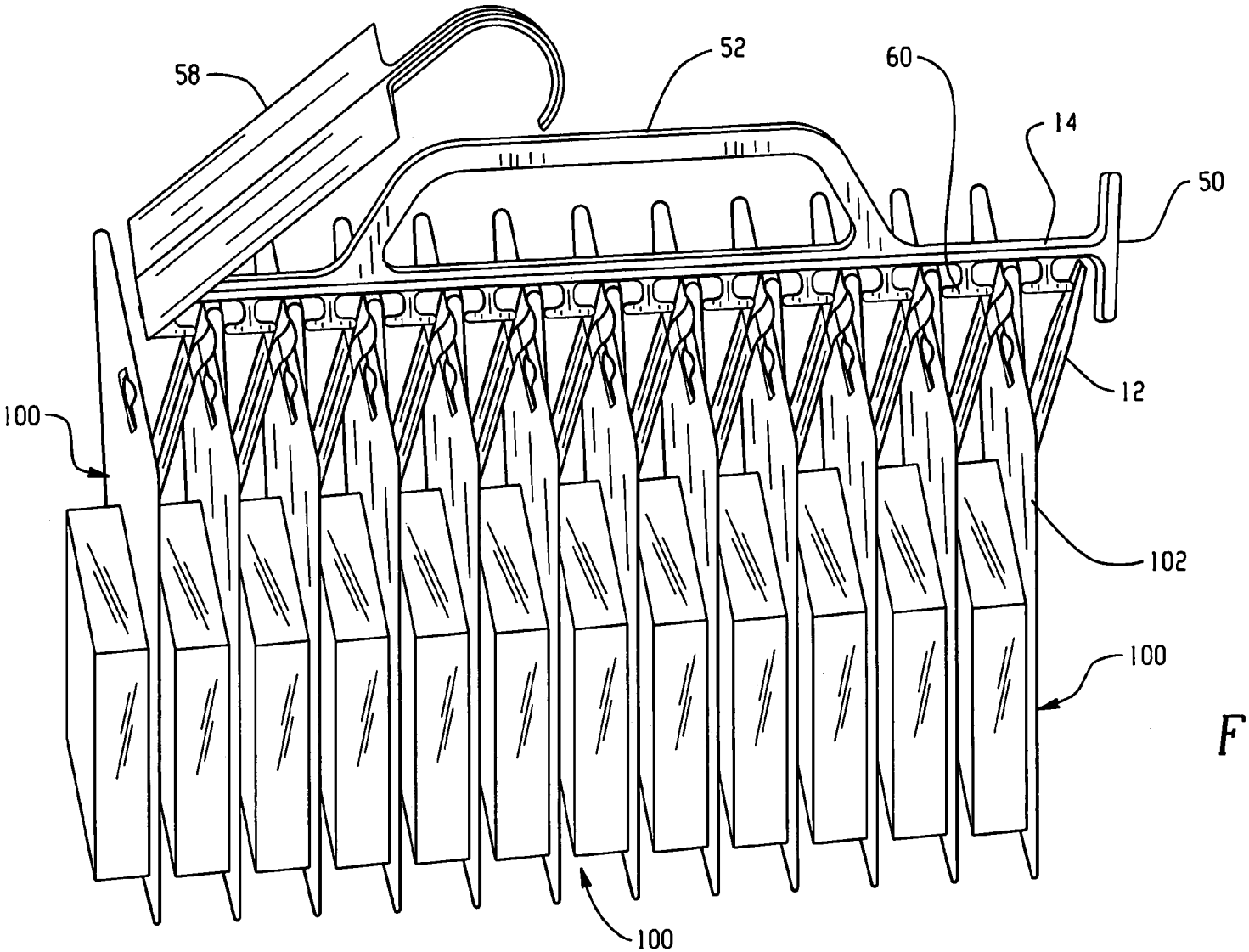
FIG. 8 is an isometric view of the apparatus of this invention with display articles secured to the apparatus.

FIG. 8 shows an isometric view of a loaded apparatus prior to separating handle 14 from strip 12. A plurality of display articles 100 are releasably secured to strip 12. Protrusions 60 extend from handle 14 and separate portions of the strip's intermediate segments from one another. The flat, rectangular section 58 of strip 12 forms a first end.

Figure 9:
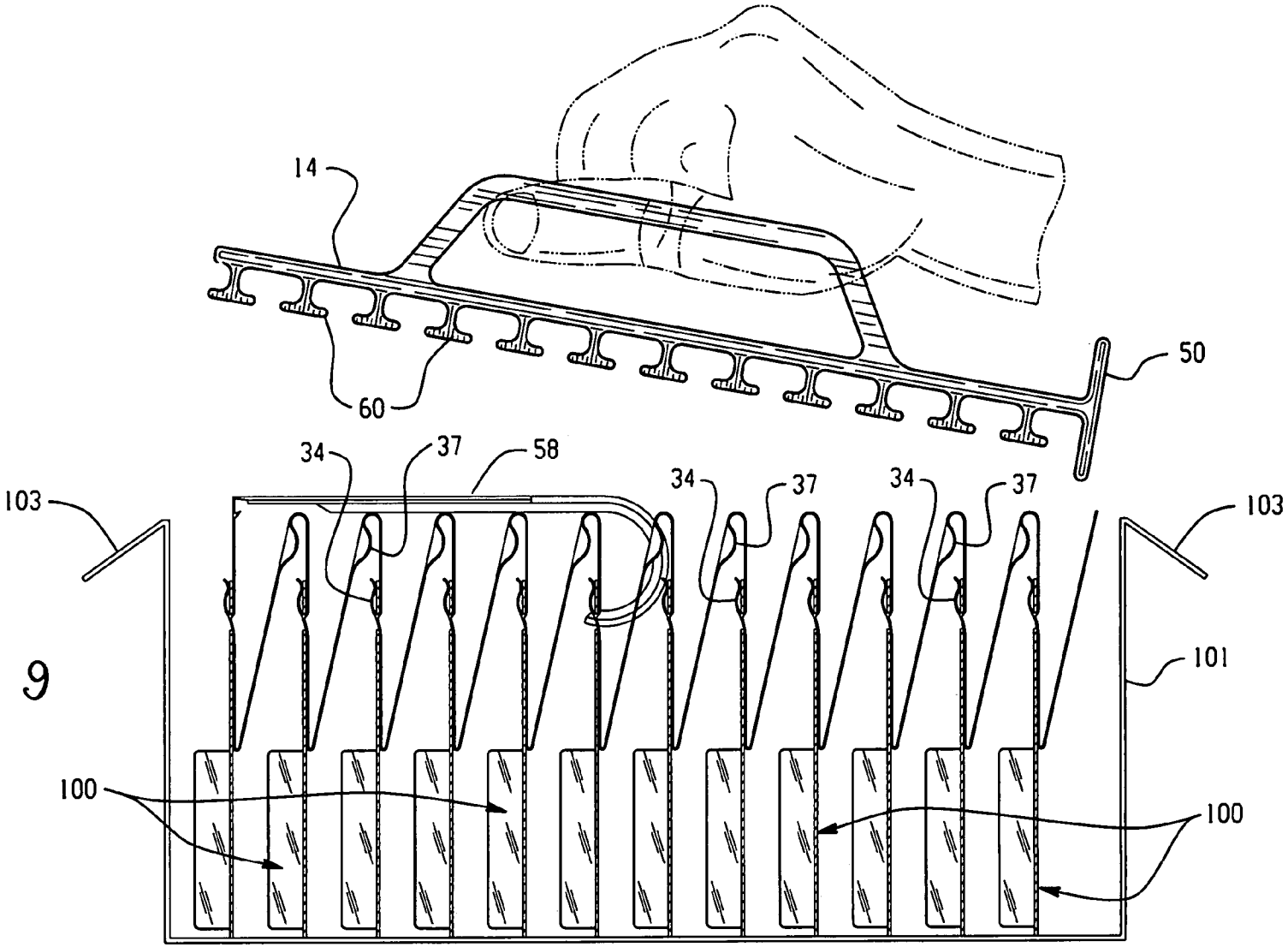
FIG. 9 is a side view of the apparatus shown in FIG. 7 after the handle has been separated from the strip.

FIG. 9 discloses a cross section of container 101 holding a plurality of display articles 100 after the apparatus' strip has fully engaged the display articles, the handle has been separated from the strip 12 and the leading end's rectangular section 58 has been folded toward the first edge 18 of undulating strip 12. Container 101 can be closed by folding over the container's flaps 103 and sealing the container with glue or tape. The loaded container can then be shipped to a store where a store employee can open the box, grasp the leading end of strip 12 and pull the loaded strip from the box as shown in FIG. 9.

Shown in FIG. 10 is a strip as it is pulled from a container after the strip has been loaded with a plurality of display articles as described above. The loaded strip is pulled from the container by grasping the leading end 54 of undulating strip shaped element 12 and pulling the loaded strip from the container. Because each of the display articles has been secured to the strip by engaging each of the display articles with a connection means located on the strip, the display articles are removed from the container as the strip is pulled from the container The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention which is defined by the following claims as interpreted according to the principles of patent law.

What is claimed is:

1. An apparatus for simultaneously attaching a plurality of articles to a foldable strip shaped merchandiser, comprising:

(a) a strip shaped element having an undulating cross sectional configuration comprising a series of folds, said strip comprising intermediate segments located between sequential folds in the strip shaped element, said intermediate segments comprising connection means located thereon; and (b) a detachable handle contacting said series of folds at one or more points of contact.

2. The apparatus of claim 1 wherein said points of contact are frangible.

3. The apparatus of claim 1 wherein said apparatus is a unitary component.

4. The apparatus of claim 1 wherein said apparatus has been formed by injection molding.

5. The apparatus of claim 4 wherein said apparatus is made from material selected from the group consisting of polyethylene, styrene, acrylonitrile-butadiene-styrene and polypropylene.

6. The apparatus of claim 1 wherein said handle comprises an elongated section having two ends and a terminal section perpendicularly abutting one of said ends.

7. The apparatus of claim 1 wherein said handle comprises an elongated section having two ends and a midsection located between said ends, said midsection located on the side of said handle opposite said points of contact.

8. The apparatus of claim 1 wherein said strip shaped element comprises two ends and at least one of said ends comprises a means for securing said strip to a support structure.

9. The apparatus of claim 8 wherein said means for securing said strip to a support structure comprises a hook.

10. The apparatus of claim 1 wherein said intermediate segments comprise connection segments and guiding segments and wherein at least one of said connection segments comprises at least one of said connection means.

11. The apparatus of claim 10 wherein said connection means comprises a tab having a proximate end secured to an intermediate segment and a distal end extending from said intermediate segment.

12. The apparatus of claim 11 wherein said tab and said intermediate segment define a partially enclosed cavity.

13. The apparatus of claim 11 wherein at least one of said guiding segments comprises a curved portion having a concave surface and a convex surface.

14. The apparatus of claim 13 wherein the shortest distance from said curved portion's convex surface to the closest connection segment is less than the shortest distance from said tab's distal end to said connection segment.

15. A process for attaching a plurality of display articles to an undulating strip shaped merchandiser, said process comprising the steps of:

(a) providing an apparatus comprising a handle and an undulating strip member secured to one another, said strip comprising a plurality of releasable connection means located along the length of said strip;

(b) providing a plurality of display articles, each article comprising at least one releasable engagement means;

(c) contacting said apparatus' strip to said plurality of display articles, said strip's connection means engaging said display articles' engagement means and releasably securing the display articles to the strip; and (d) separating said handle from said strip.

16. The process of claim 15, wherein, in step (a), said strip comprises a plurality of folds, located along the length of said strip, and intermediate segments located between sequential folds in said strip, said intermediate segments comprising at least one connection segment comprising at least one connection means, said intermediate segments further comprising at least one guiding segment located adjacent said connection segment; and in step (c), prior to said connection means engaging said display articles' engagement means, each of said display articles contacts the at least one guiding segment and the at least one connection segment.

17. The process of claim 16, wherein said guiding segment comprises a curved portion having a concave surface and a convex surface, and said connection segment comprises a tab having a proximate end secured to said connection segment and a distal end extending from said connection segment towards said guiding segment, wherein said display articles contact said curved portions' convex surfaces before said tabs engage the display articles' engagement means.

18. The process of claim 17, wherein sad convex surfaces laterally displace said display articles toward said connection segments.

19. The process of claim 18, wherein each of said display articles comprise an opening therethrough and at least one of said connection segments comprises the tab extending through at least one of said openings.

20. The process of claim 15, wherein during the step of contacting said apparatus' strip to said plurality of display articles, said apparatus' strip connection means simultaneously contacts said display articles' engagement means.

21. The process of claim 15, wherein said strip is secured to said handle at two or more points of contact.

22. The process of claim 21, wherein said step of separating said handle from said strip member comprises breaking the points of contact that secure the handle to the strip member.

23. The process of claim 15, wherein, prior to providing said apparatus comprising said handle and strip, said handle and strip are formed as a unitary member.

24. The process of claim 15, wherein, prior to providing said apparatus comprising said handle and strip, said handle and strip are formed as separate components and then secured to one another.

25. The process of claim 15, wherein said strip member's connection means comprises a tab having a proximate end secured to said strip member and a distal end extending from said strip member.

26. The process of claim 25, wherein said tab and said strip member cooperatively define a partially enclosed cavity.

27. The process of claim 26, wherein said strip's connection means employs said tab and cavity to suspend said article from said strip member.

28. The process of claim 15, wherein each of said display articles comprises a planar component defining an opening therethrough.

29. The process of claim 28, wherein said distal end of said tab extends through said opening thereby releasably securing said display article to said strip member.

30. The process of claim 28, wherein said planar component comprises at least one edge defining the perimeter of said planar component and said opening is located proximate said edge.

31. The process of claim 15, wherein said step of contacting said apparatus to said display articles comprises moving said apparatus toward said display articles and then moving said apparatus away from said display articles.

32. The process of claim 15, wherein said step of providing a plurality of display articles comprises aligning said separating said display articles to correspond with the distance between said strip member's connection means located along the length of said strip.

33. The process of claim 15, wherein said step of separating said handle from said strip member comprises releasing said handle from said strip member.

34. The process of claim 15, wherein said handle comprises a linear elongated portion that contacts said strip member.

35. The process of claim 34, wherein said linear portion comprises protrusions that extend from said linear portion toward said strip member.

36. The process of claim 15, wherein one end of said strip member comprises a means for securing said strip to a support structure.

* * * * *